US011573532B2

(12) United States Patent
Helfer et al.

(10) Patent No.: US 11,573,532 B2
(45) Date of Patent: Feb. 7, 2023

(54) DEVICE FOR GUIDING PIVOTALLY AND HOROLOGICAL RESONATOR MECHANISM FOR A PIVOTING MASS

(71) Applicant: ETA SA Manufacture Horlogere Suisse, Grenchen (CH)

(72) Inventors: Jean-Luc Helfer, Le Landeron (CH); Pascal Winkler, St-Blaise (CH)

(73) Assignee: ETA SA Manufacture Horlogere Suisse, Grenchen (CH)

( * ) Notice: Subject to any disclaimer, the term of this patent is extended or adjusted under 35 U.S.C. 154(b) by 255 days.

(21) Appl. No.: 16/908,978

(22) Filed: Jun. 23, 2020

(65) Prior Publication Data

US 2021/0034016 A1 Feb. 4, 2021

(30) Foreign Application Priority Data

Jul. 29, 2019 (EP) ..... 19188844

(51) Int. Cl.
*G04B 17/04* (2006.01)
*G04B 17/32* (2006.01)

(52) U.S. Cl.
CPC ..... *G04B 17/045* (2013.01); *G04B 17/32* (2013.01)

(58) Field of Classification Search
CPC ..... G04B 17/32; G04B 17/28; G04B 17/045; G04B 31/02; G04B 31/00; G04B 15/14; G04B 17/26; G04B 15/02; G04B 17/04
See application file for complete search history.

(56) References Cited

U.S. PATENT DOCUMENTS 9,477,205 B2 * 10/2016 Born ..... G04C 3/101
10,394,190 B2 * 8/2019 Lechot ..... G04B 31/02
(Continued)

FOREIGN PATENT DOCUMENTS

CN 106662839 A 5/2017
CN 107024852 A 8/2017
(Continued)

OTHER PUBLICATIONS

Combined Chinese Office Action and Search Report dated Aug. 17, 2021 in corresponding Chinese Patent Application No. 202010755490.1 (with English Translation of Category of Cited Documents), 6 pages.

(Continued)

*Primary Examiner* — Edwin A. Leon
(74) *Attorney, Agent, or Firm* — Oblon, McClelland, Maier & Neustadt, L.L.P.

(57) ABSTRACT

A device for guiding a pivoting mass about an axis. A first support is fixed and a second support forms or supports the pivoting mass. The device is includes a first and second flexible leaf oriented in the same direction when the device is at rest, and an intermediate leaf having a rigidity notably greater than the flexible leaves and connecting the first flexible leaf to the second, the device including a first fixed link formed by the first support and a first end of the first leaf, a second fixed link formed by a second end of the first leaf and by a first end of the intermediate leaf, a third fixed link formed by a second end of the intermediate leaf and by a first end of the second leaf and a fourth fixed link formed by at least one second end of the second leaf, wherein the first and/or the fourth link is arranged substantially between the second and the third link in the direction when the device is at rest.

20 Claims, 4 Drawing Sheets

(56) References Cited

U.S. PATENT DOCUMENTS

| | | | | |
|---|---|---|---|---|
| 2013/0176829 | A1* | 7/2013 | Cusin | G04B 13/025 368/127 |
| 2017/0227930 | A1 | 8/2017 | Di Domenico et al. | |
| 2019/0064741 | A1 | 2/2019 | Di Domenico et al. | |
| 2019/0064742 | A1 | 2/2019 | Di Domenico et al. | |

FOREIGN PATENT DOCUMENTS

| | | | |
|---|---|---|---|
| CN | 107065493 | A | 8/2017 |
| EP | 3 206 089 | A1 | 8/2017 |
| EP | 3 451 072 | A1 | 3/2019 |
| JP | 2017-142246 | A | 8/2017 |
| JP | 2019-45491 | A | 3/2019 |

OTHER PUBLICATIONS

European Search Report dated Jan. 17, 2020 in European Application 19188844.5 filed Jul. 29, 2019 (with Written Opinion and English Translation of Categories of Cited Documents), 7 pages.
Japanese Office Action dated Jul. 13, 2021 in Japanese Patent Application No. 2020-120370 (with English translation), 7 pages.

* cited by examiner

DEVICE FOR GUIDING PIVOTALLY AND HOROLOGICAL RESONATOR MECHANISM FOR A PIVOTING MASS

CROSS-REFERENCE TO RELATED APPLICATION

This application claims priority to European Patent Application No. 19188844.5 filed on Jul. 29, 2019, the entire disclosure of which is hereby incorporated herein by reference.

FIELD OF THE INVENTION

The invention relates to a device for guiding pivotally for a pivoting mass.

The invention also relates to an horological resonator mechanism including at least two devices for guiding pivotally.

The invention also relates to an horological movement including such a resonator mechanism.

BACKGROUND OF THE INVENTION

Flexible guides with a virtual pivot allow to substantially improve horological resonators. The simplest ones are cross-spring pivots, composed of two guide devices with straight leaves that intersect, in general perpendicularly. These two leaves can be either three-dimensional in two different planes, or two-dimensional in the same plane and are thus as if they were welded at their point of intersection.

It is possible to optimise a three-dimensional cross-spring pivot for an oscillator, to try to make it isochronous with a rate independent of its orientation in the field of gravity, in particular in two ways (independently, or the two together):

- choosing the position of the intersection of the leaves with respect to their setting to have a rate independent of the positions;
- choosing the angle between the leaves to be isochronous and have a rate independent of the amplitude.

However, the use of such devices does not allow to achieve perfect deflection of the leaves. Indeed, obtaining a virtual axis sufficiently stable during the pivoting for the rotary movement of the mass to be perfectly periodic is not achieved. The return torque is not exactly linear, which causes an anisochronism according to the amplitude of the mass.

Moreover, the centre of mass of the mechanism moves too much, and also causes an anisochronism caused by its orientation with respect to gravity.

SUMMARY OF THE INVENTION

The invention seeks to avoid the aforementioned defects and aims to improve the behaviour of flexible pivots, in particular for their use in a resonator mechanism.

The invention thus relates to a device for guiding rotatably pivotally a pivoting mass about a virtual pivoting axis, the device comprising a first support and a second support, one of which is fixed and the other of which is intended to be rotary and to form or to support the pivoting mass, the device being substantially arranged in a plane and comprising a first and a second flexible leaf oriented in the same direction when the device is at rest, as well as an intermediate leaf having a rigidity notably greater than the flexible leaves and connecting the first flexible leaf to the second, the device comprising a first fixed link formed by the first support and a first end of the first leaf, a second fixed link formed by a second end of the first leaf and by a first end of the intermediate leaf, a third fixed link formed by a second end of the intermediate leaf and by a first end of the second leaf and a fourth fixed link formed by at least one second end of the second leaf.

The device is remarkable in that the first and/or the fourth link is arranged substantially between the second and the third link in said direction when the device is at rest.

Thus, the invention is a cross-spring pivot comprising an intermediate leaf having a rigidity greater than the flexible leaves and the first and/or the fourth fixed link of which is arranged between the second and the third fixed link. Such a pivot allows to keep a more stable centre of mass during the pivoting of the mass, in order for the flexibility and the return torque to be more linear. The problems of anisochronism caused by gravity are also greatly reduced, in particular in a resonator mechanism, so that the horological mechanical movements are more precise.

According to a specific embodiment of the invention, the fourth fixed link is arranged between the second end of the second leaf and the second support, which is rotary, the first support being fixed.

According to a specific embodiment of the invention, the fourth link is arranged between the second and the third link in said direction when the device is at rest.

According to a specific embodiment of the invention, the first and the fourth link are arranged between the second and the third link in said direction when the device is at rest.

According to a specific embodiment of the invention, the intermediate leaf is elbowed, preferably in the shape of a U.

According to a specific embodiment of the invention, the intermediate leaf is flexible with a cross-sectional inertia greater than that of the flexible leaves.

According to a specific embodiment of the invention, the intermediate leaf has a length $x_1$ defined by the following equation:

$$x_1 = -\frac{L_1^3 + 3L_1^2|L_2| + 3L_1L_2|L_2| + L_2^3}{6L_1|L_2|};$$

where $L_1$ is the length of the first flexible leaf and $L_2$ is the length of the second flexible leaf.

According to a specific embodiment of the invention, the distance between the fourth link and the centre of mass of the pivoting mass is a length $x_2$ defined by the following equation:

$$x_2 = \frac{L_1^3 - 3L_1L_2|L_2| - 2L_2^3}{6|L_2|(L_1 + |L_2|)};$$

where $L_1$ is the length of the first flexible leaf and $L_2$ is the length of the second flexible leaf.

According to a specific embodiment of the invention, the length of the first leaf $L_1$=L, and the intermediate leaf has a length $x_1$ defined by the following equation: $x_1$=36/25L.

According to a specific embodiment of the invention, the length $L_1$ of the first leaf $L_1$=L, and the distance between the fourth link and the centre of mass of the pivoting mass is a length $x_2$ defined by the following equation: $x_2$=3/5L.

According to a specific embodiment of the invention, the second flexible leaf has a length $L_2$ defined by the following equation:

$$L_2 = \frac{L}{5}.$$

According to a specific embodiment of the invention, the device comprises a second intermediate leaf, the fourth link being formed by the second end of the second leaf and a first end of the second intermediate leaf, the first support being rotary.

According to a specific embodiment of the invention, the device comprises a third flexible leaf between the second intermediate leaf and the second fixed support, the device comprising a fifth fixed link formed by a second end of the second intermediate leaf and by a first end of the third leaf, as well as a sixth fixed link formed by at least one second end of the third leaf.

According to a specific embodiment of the invention, the sixth fixed link is formed by the second end of the third leaf and the second fixed support.

According to a specific embodiment of the invention, the fifth and the sixth link are arranged between the second and the third link in said direction when the device is at rest.

The invention also relates to an horological resonator mechanism including a pivoting mass arranged to pivot in a rotary manner about a virtual pivoting axis, the mechanism comprising two flexible devices for guiding rotatably pivotally according to the invention.

According to a specific embodiment of the invention, the directions of the flexible leaves of the respective devices are substantially perpendicular to one another when the mechanism is at rest.

According to a specific embodiment of the invention, the mechanism includes a third guide device, the three devices being superimposed.

According to a specific embodiment of the invention, the devices are distributed angularly, so that the directions of the flexible leaves of the three guide devices are arranged at 120° two by two.

According to a specific embodiment of the invention, the rotary supports of the devices are rigidly connected.

According to a specific embodiment of the invention, the fixed supports of the devices are rigidly connected.

According to a specific embodiment of the invention, the flexible leaves of each device have the same length two by two.

According to a specific embodiment of the invention, the devices are arranged on parallel planes.

The invention also relates to an horological movement including such an horological resonator mechanism.

BRIEF DESCRIPTION OF THE DRAWINGS

Other features and advantages of the invention will appear upon reading the following detailed description, in reference to the appended drawings, in which.

DETAILED DESCRIPTION

Figure 1:
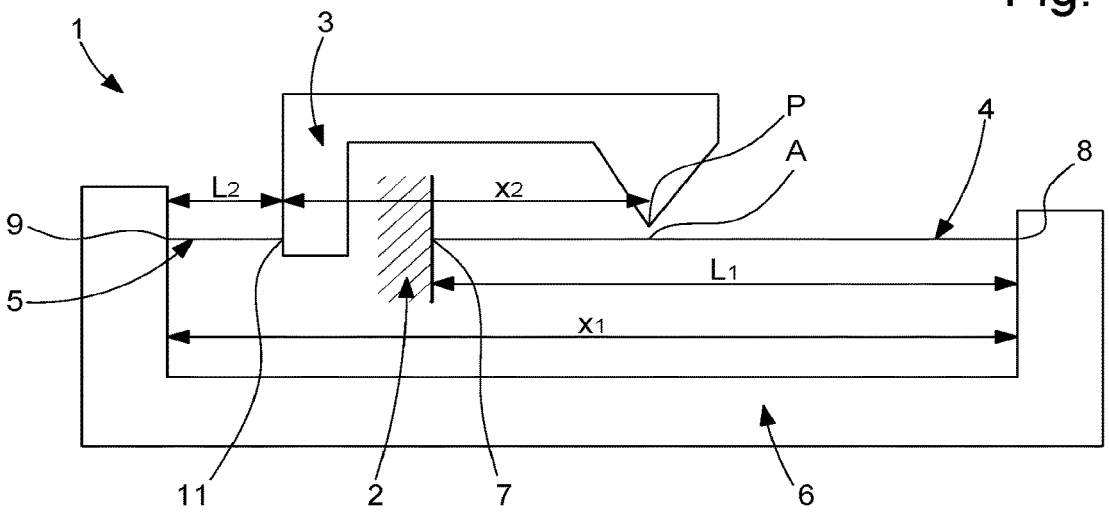
FIG. 1 schematically shows a device for guiding pivotally according to the invention, FIG. 2 schematically shows a resonator mechanism comprising two devices for guiding pivotally according to a first embodiment of the invention.

The invention relates to a device 1 for guiding rotatably pivotally a pivoting mass about a virtual pivoting axis A, as shown in FIG. 1. The device is preferably arranged substantially in a plane. The pivoting axis A is perpendicular to the plane of the device 1. The device 1 comprises a fixed support 2 and a rotary support 3 intended to form or to support the pivoting mass.

The device 1 comprises a first 4 and a second flexible leaf 5 as well as an intermediate leaf 6 connecting the first flexible leaf 4 to the second 5. The first 4 and the second leaf 5 preferably have a similar, or even identical, cross-sectional inertia. The invention is illustrated in a preferred particular case in which the most flexible leaves are straight. Other geometries are nevertheless possible, for example in the shape of a coil, or others.

The intermediate leaf 6 has a rigidity notably greater than the flexible leaves 4, 5. In other words, the intermediate leaf 6 has a greater stiffness coefficient that the flexible leaves.

According to a first embodiment, the coefficient of the intermediate leaf 6 is much greater, so that the intermediate leaf 6 is considered to not be flexible under the effect of the pivoting mass.

According to a second embodiment, the intermediate leaf 6 is also flexible, but less than the first 4 and the second leaf 5. In this case, the difference in flexibility between the two types of leaves is still notable. Thus, the intermediate leaf 6 is flexible under the effect of the pivoting mass. For this purpose, the intermediate leaf 6 has, for example, a greater cross-section than the flexible leaves 4, 5 if they are made from the same material. Preferably, the first 4 and the second flexible leaf 5 have an identical cross-section.

FIG. 1 shows the device 1 at rest, that is to say that the rotary support 3 does not pivot and remains in an immobile stable position. As shown in FIG. 1, the first 4 and the second leaf 5 are oriented in the same direction when the device 1 is at rest.

The device 1 comprises four fixed links of the leaves 4, 5, 6:

- a first fixed link 7 formed by the fixed support 2 and a first end of the first leaf 4,
- a second fixed link 8 formed by a second end of the first leaf 4 and a first end of the intermediate leaf 6,
- a third fixed link 9 formed by a second end of the intermediate leaf 6 and a first end of the second leaf 5, and
- a fourth fixed link 11 formed by a second end of the second leaf 5 and the rotary support 3.

The term fixed link means that the ends are durably fastened to one another, for example one end being rigidly set in the other.

In the rest position, the first leaf 4 is substantially perpendicular to the fixed support 2, and the second leaf 5 is substantially collinear to the first leaf 4, while the intermediate leaf 6 is substantially parallel to the first 4 and second 5 leaves. Thus, the four fixed links are aligned in the same direction of the flexible leaves 4, 5 in the rest position. In FIG. 1, the rotary support 3 has the shape of an L to offset the support 3 with respect to the flexible leaves 4, 5. The base of the L is perpendicular to the flexible leaves 4, 5, and includes the fourth fixed link 11. The back of the L is parallel to the flexible leaves 4, 5, and is moreover provided with a curved free tip P. The free tip P is only intended to indicate the location of the centre of mass of the device 1. Via the device according to the invention, the free tip P, and thus the centre of mass, moves very little during the pivoting of the support 3.

According to the invention, the first 7 and/or the fourth fixed link 11 is arranged between the second 8 and the third fixed link 9, when the device 1 is at rest. In the embodiment of FIG. 1, the first 7 and the fourth fixed link 11 are arranged between the second 8 and the third fixed link 9, when the device 1 is at rest. Thus, the first 4 and the second 5 flexible leaf are arranged in the intermediate leaf 6 in the rest position.

For this purpose, the intermediate leaf 6 is elbowed, here in the shape of a straight U, to be able to partly surround the first 7 and the fourth fixed link 11. The base B of the U is the longest and has a length $x_1$ defined by the following equation:

$$x_1 = -\frac{L_1^3 + 3L_1^2|L_2| + 3L_1L_2|L_2| + L_2^3}{6L_1|L_2|};$$

where $L_1$ is the length of the first flexible leaf 4 and $L_2$ is the length of the second flexible leaf 5. The lengths are vectors defined with respect to axes and an origin, not shown in the drawings. It is understood that the negative values are oriented in the reverse direction to the positive values. Thus, certain values can be negative, like $L_1$ or $L_2$, and consequently $x_1$ or $x_2$.

Moreover, the distance between the fourth fixed link 11 and the centre of mass of the pivoting mass is a length $x_2$ formed by the back of the L and defined by the following equation:

$$x_2 = \frac{L_1^3 - 3L_1L_2|L_2| - 2L_2^3}{6|L_2|(L_1 + |L_2|)}.$$

Via these dimensions, the centre of mass of the system is more stable when the device pivots, since the centre of mass of the pivoting mass is immobile until the second order of the limited development of the position of the centre of mass with respect to the angle of deflection in the plane of the device 1.

In a preferred mode, a length $L_1$=L of the first leaf 4 and a length $$L_2 = \frac{L}{5}$$

of the second flexible leaf 5 are chosen. Thus, the flexible leaves 4, 5 do not risk colliding during the pivoting. Having to dispose the leaves on two different levels to avoid impacts is avoided. Consequently, the length $x_1$ of the intermediate leaf 6 is defined by the following equation: $x_1$=−36/25L; and the rotary support 3 has a length $x_2$ defined by the following equation: $x_2$=3/5 L, which corresponds to the distance between the fourth fixed link 11 and the centre of mass of the pivoting mass.

In an advantageous embodiment, the first fixed support 11, the second fixed support 12, and the leaves form a one-piece assembly. This one-piece assembly can be made by technologies of the MEMS or LIGA type or similar, from silicon or similar, thermally compensated, in particular by a particular local growth of silicon dioxide, in certain zones of the part arranged for this purpose, when this one-piece assembly is made of silicon.

According to a third embodiment, not shown in the drawings, the device comprises a second intermediate leaf and a third flexible leaf, the rotary and fixed supports being inversed with respect to the previous embodiments. Thus, the first fixed link is formed by the rotary support and the first end of the first flexible leaf, the second fixed link is formed by the second end of the first flexible leaf and the first end of the first intermediate leaf, the third fixed link is formed by the second end of the first intermediate leaf and the first end of the second flexible leaf, while the fourth fixed link is formed by the second end of the second flexible leaf and by a first end of the second intermediate leaf. The device includes a fifth fixed link formed by a second end of the second intermediate leaf and a first end of the third flexible leaf, as well as a sixth fixed link formed by the second end of the third flexible leaf and the fixed support. In this embodiment, the first, fourth, fifth and sixth fixed links are for example arranged between the second and the third fixed link, when the device is at rest.

Figure 2:
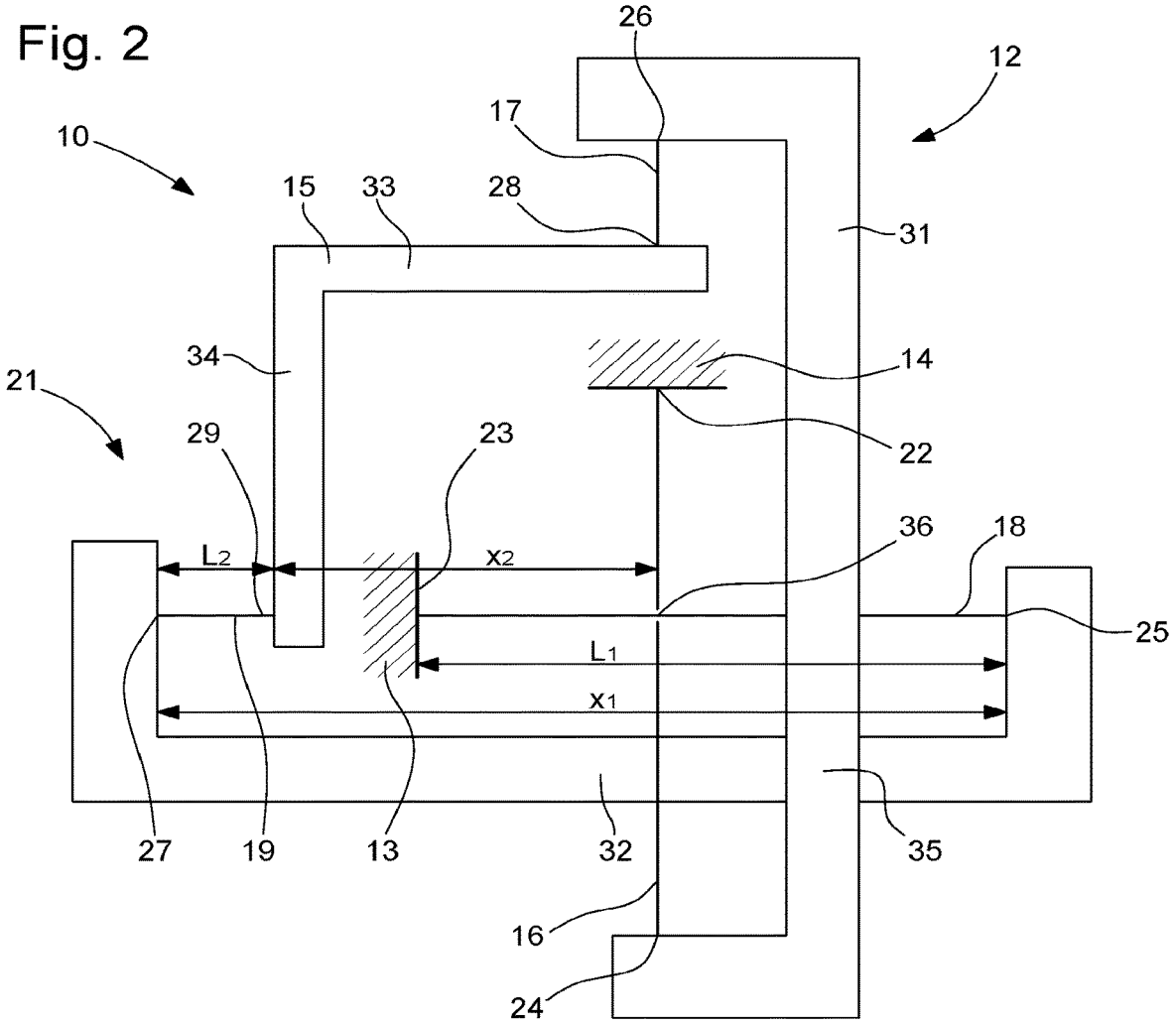

FIG. 2 shows a first embodiment of a resonator mechanism 10 comprising two devices 12, 21 for guiding pivotally similar to that described above. The first guide device 12 includes a first fixed support 14 and a first rotary support 33, a first 16 and a second 17 flexible leaf, as well as a first intermediate leaf 31 connecting the first flexible leaf 16 to the second 17. The second guide device 21 includes a second fixed support 13 and a second rotary support 34, a third 18 and a fourth 19 flexible leaf, as well as a second intermediate leaf 32 connecting the third flexible leaf 18 to the fourth 19. The respective flexible leaves 16, 17, 18, 19 of the two devices 12, 21 have the same length two by two. Thus, the first leaf 16 of the first device 12 and the third leaf 18 of the second device 21 have the same length, just as the second leaf 17 of the first device 12 and the fourth leaf 19 of the second device 21 have the same length. The intermediate leaves 42, 45 are disposed in such a way that the bases of the Us are oriented towards the outside of the mechanism.

The two devices 12, 21 are arranged on two parallel planes to be able to pivot without collision of the leaves. In this example, the two devices 12, 21 are substantially perpendicular to one another. Thus, the directions of the flexible leaves 16, 17, 18, 19 of the respective devices 12, 21 are substantially perpendicular when the mechanism 10 is at rest.

In other embodiments, the devices can be oriented differently, by forming an angle different than 90° between them, for example 60°.

Moreover, the directions of the flexible leaves are straight. The intermediate leaves 31, 32 of the two devices 12, 21 are substantially perpendicular in the rest position, and intersect at a first point 35. Since the devices 12, 21 are on two different planes, the leaves do not collide during the operation of the mechanism 10. The first 16 and the third 18 flexible leaf are substantially perpendicular in the rest position, and intersect at a second point 36 defining the centre of mass of the rotary support and of the pivoting mass. The second point 36 also defines the position of the virtual axis around which the rotation of the mechanism occurs, in particular for the pivoting mass. The pivoting axis is substantially perpendicular to the planes of the devices.

The rotary supports 33, 34 of the two devices are rigidly connected to one another, just like the fixed supports 22, 23 of the two devices 12, 21. Here, the rotary supports 33, 34 have the shape of a straight leaf, which can be of the same nature as the intermediate leaves, preferably not flexible. The rotary supports 33, 34 are substantially perpendicular to the flexible leaves 16, 17, 18, 19 of the respective devices 12, 21. The rotary supports 33, 34 are fastened to one another by their opposite ends in order to form a corner 15 in the shape of a bracket. The corner 15 can form a support for an oscillating mass of the mechanism, a balance for example.

When the mechanism 10 is actuated, the two devices 12, 21 pivot, so that the corner 15 carries out a periodic balance movement about the virtual axis. The movement is produced via the flexible leaves which bend under the effect of the movement of the rotary supports with or without the mass.

The resonator mechanism 10 can include a plurality of such flexible devices for guiding pivotally 12, 21 mounted in series, to increase the total angular travel, disposed in parallel planes, and around the same virtual pivoting axis A.

FIGS. 3 to 6 are alternatives of a second embodiment of a mechanism 20, 30, 40 comprising two devices 58, 59 according to the invention, and in which only the fourth fixed link 51, 55 is arranged between the second 48, 53 and the third fixed link 49, 54 in the rest position. The devices 58, 59 each include two flexible leaves 39, 41, 43, 44 and an intermediate leaf 42, 45. Like in the first embodiment, the devices 58, 59 are substantially perpendicular with respect to one another.

In each of them, the first fixed link 47, 52 is arranged outside of the intermediate leaf 42, 45. Thus, the first flexible leaf 39, 43 is outside of the intermediate leaf 42, 45.

Thus, the mechanism is more compact than that of the first embodiment. The intermediate leaves 42, 45 have the shape of a deformed U, in which the branch linked to the first flexible leaf 39, 43 by the first fixed link 48, 53 is slightly convex and longer than the other, the base of the U being concave towards the inside of the U. The fixed supports are identical in the various alternatives, and together form a first arc of a circle 37 having an angle substantially equal to 90°. The first arc 37 includes a first attachment 46, here a ring arranged on the outer part of the arc 37 in the plane of the device, in order to be able to fasten the resonator mechanism to an horological movement.

Figure 3:
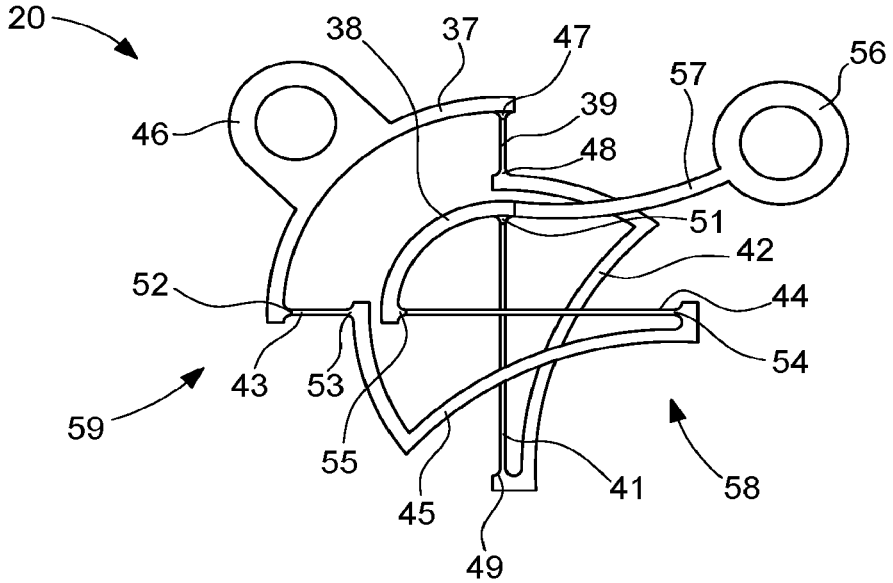
FIG. 3 shows a top view of a resonator mechanism according to a first alternative of a second embodiment.
Figure 4:
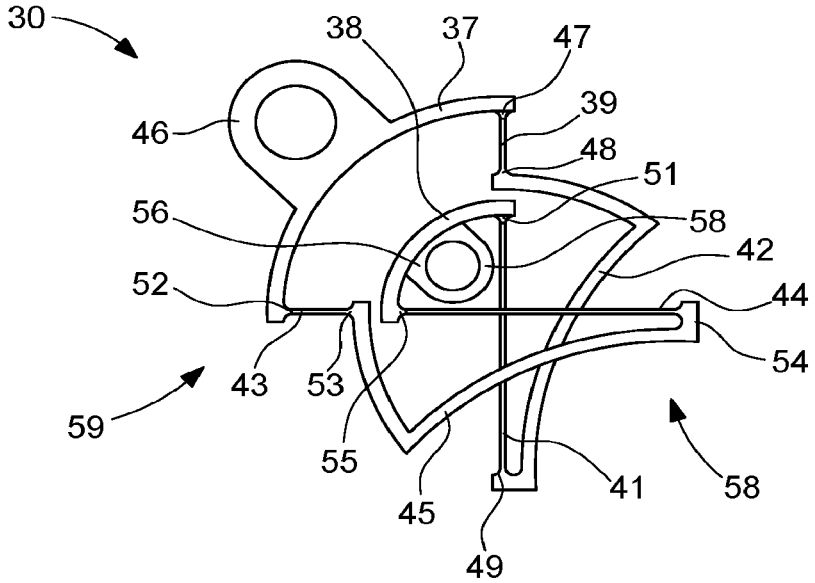
FIG. 4 shows a top view of a resonator mechanism according to a second alternative of the second embodiment.

In the alternatives of FIGS. 3 and 4, the two rotary supports together form a second arc of a circle 38 smaller than the first, having an angle substantially equal to 90°, the centre of which is substantially the same as that of the first arc 37. The first 37 and the second arc 38 are substantially parallel in the rest position. A second attachment 56 is added onto the second arc 38. The second attachment 56 is a ring. The second attachment 56 allows to fasten an oscillating mass, for example a balance of an horological movement.

The ring forming the second attachment 56 of FIG. 4 is remote with respect to the mechanism 20 and is connected by an additional leaf 57, which can also be flexible, to an end of the second arc 38.

In FIG. 4 of the other alternative, the second attachment 56 is fastened onto and centred on the second arc of a circle 38.

Figure 5:
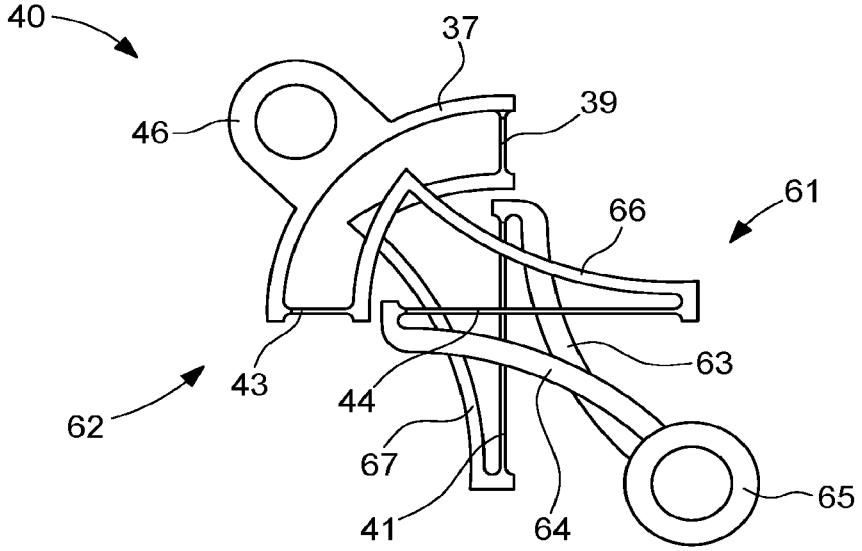
FIG. 5 shows a top view of a resonator mechanism according to a third alternative of the second embodiment.
Figure 6:
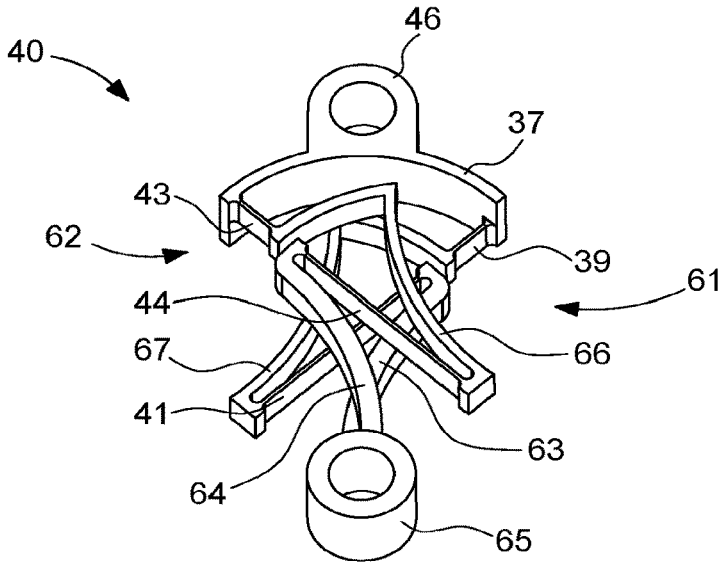
FIG. 6 shows a perspective view of the third alternative of the second embodiment of FIG. 5.

In the alternative of FIGS. 5 and 6 of the resonator mechanism 40, the devices 61, 62 are arranged so that the base of the U of the intermediate leaves 66, 67 is oriented towards the inside of the mechanism, via symmetry of the intermediate leaves of the previous alternatives with respect to the direction of the flexible leaves 39, 41, 43, 44. The rotary supports 63, 64 are curved, and intersect in different planes before reaching the second attachment 65. The second attachment 65 is arranged symmetrically opposite to the first attachment 46 with respect to the centre of mass of the mechanism formed at the intersection of the second flexible leaves 41, 44. The perspective view of FIG. 6 allows to observe the two levels of two devices 61, 62. It is noted that the first arc 37 formed by the fixed supports, as well as the second attachment 65 have a thickness sufficient to allow the fixed links in the two different planes.

Regardless of the alternative, when the mechanism 20, 30, 40 is actuated, the two devices pivot, so that the attachment carries out a periodic balance movement about the virtual axis. The movement is produced via the flexible leaves which bend under the effect of the movement of the rotary supports with or without the mass.

Figure 7:
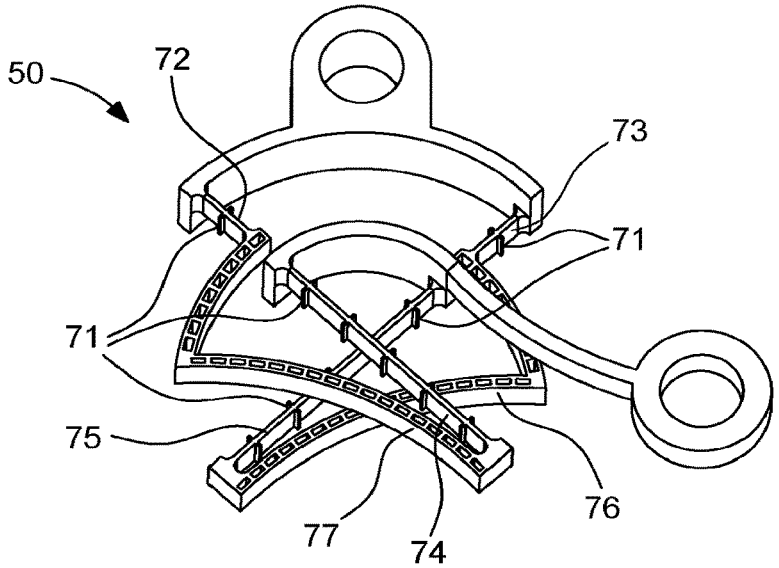
FIG. 7 shows a perspective view of an improved version of the resonator mechanism of FIG. 3.

FIG. 7 shows a resonator mechanism 50 similar to that of FIG. 3, in which the flexible leaves 72, 73, 74, 75 include lateral reinforcements 71 to avoid the anticlastic curvature of the leaf. The reinforcements consist of ribs arranged on either side of the leaf to locally increase the thickness of the leaf 72, 73, 74, 75. The ribs are disposed periodically on each face of the leaf, preferably disposed over the entire height of the leaf 72, 73, 74, 75.

In this embodiment, the intermediate leaves 76, 77 further have a cellular structure in the thickness of the leaf. The cells are tubular over the entire height of the leaf to obtain "skeletal" leaves. Thus, the weight of the intermediate leaves 76, 77 is reduced while keeping sufficient rigidity.

Embodiments including only one of these two additional features are of course possible.

Figure 8:
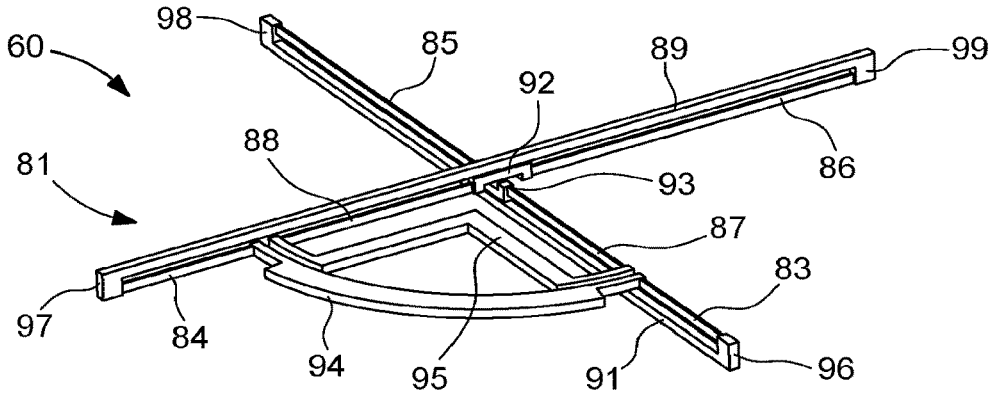
FIG. 8 shows a perspective view of a resonator mechanism according to a third embodiment.

FIG. 8 shows a third embodiment of a resonator mechanism 60 comprising two guide devices 81, 82 each having three flexible leaves 83, 84, 85, 86, 87, 88, and two intermediate leaves 89, 91, 92, 93 according to the third embodiment of the device 81, 82 for guiding pivotally described above. The two devices 81, 82 are disposed perpendicularly and intersect at the second intermediate leaves 92, 93. The second intermediate leaves 92, 93 describe a recess to not be in contact with one another. For this, they have the shape of a U, and can fit together perpendicularly one in the other without touching. The first intermediate leaves 89, 91 also have the shape of a U, the length of which corresponds to that of their specific device 81, 82. The length of each second flexible leaf 85, 86 substantially corresponds to the added length of the first 83, 84 and of the third intermediate leaf 87, 88 of their respective device 81, 82.

The flexible leaves 83, 84, 85, 86, 87, 88, the second intermediate leaves 92, 93, and the rotary and fixed supports of the two devices 81, 82 are arranged in the same plane. The first intermediate leaves 89, 91 are arranged in a second plane parallel to the first.

The rotary supports of the devices 81, 82 are rigidly connected and form an arc of a circle 94. The fixed supports of each device 81, 82 are also rigidly connected to one another in such a way as to form a corner 95 in the arc of a circle 94. The arc of a circle 94 can move with respect to the corner 95 when the mechanism is moving.

For each device 81, 82 in the rest position, the first, fourth, fifth and sixth fixed links are arranged between the second 96, 97 and the third fixed link 98, 99.

Figure 9:
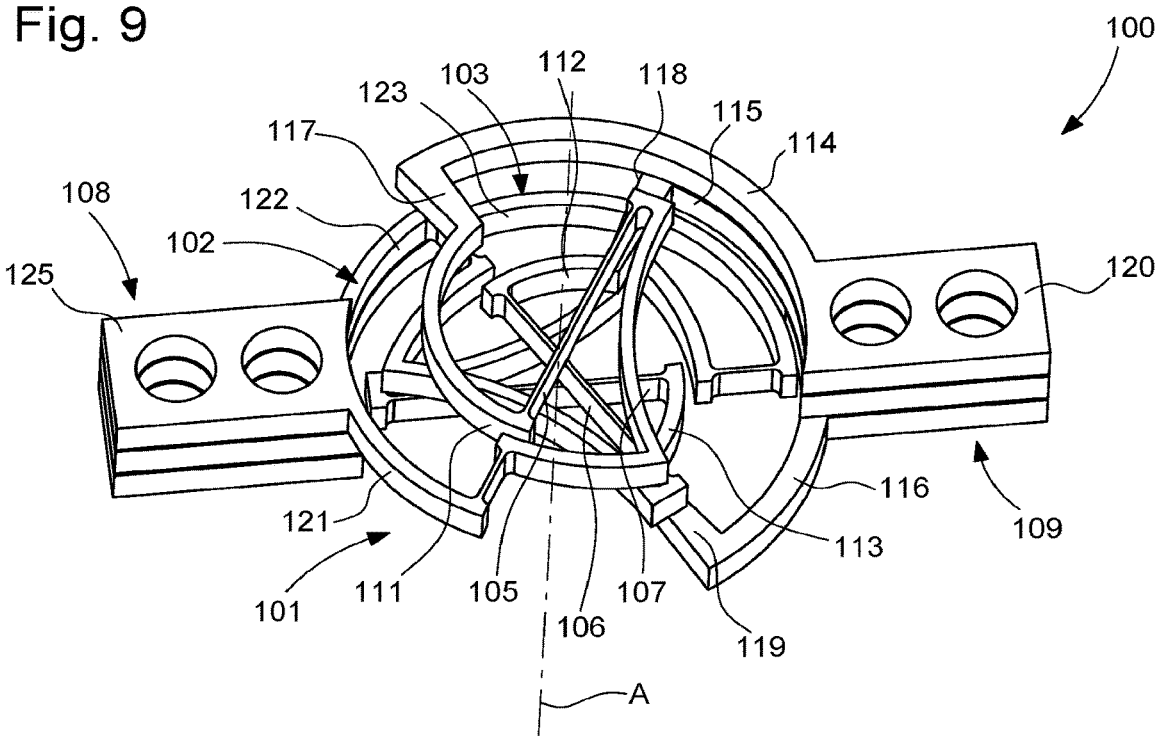
FIG. 9 shows a perspective view of a resonator mechanism according to a fourth embodiment.
Figure 10:
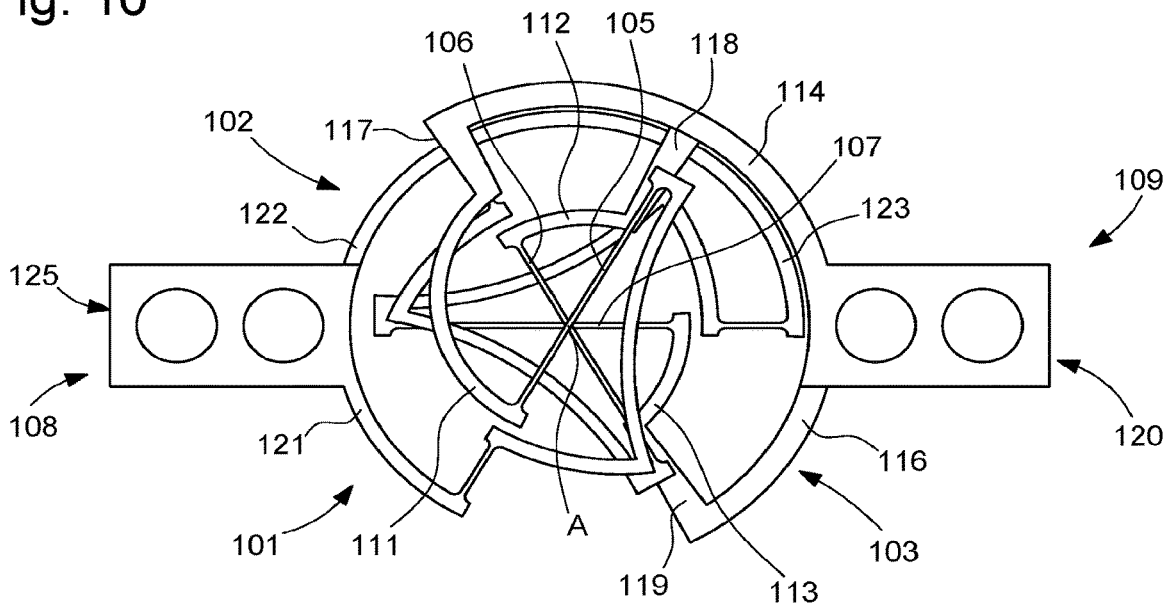
FIG. 10 shows a top view of the resonator mechanism according to the fourth embodiment.

FIGS. 9 and 10 show a fourth embodiment of a resonator mechanism 100 including three guide devices 101, 102, 103, distributed angularly around an axis of symmetry A of the mechanism. The devices 101, 102, 103 are superimposed and oriented in such a way as to form an angle of 120° between them. Thus, the directions of the flexible leaves of the three guide devices 101, 102, 103 are arranged at 120° two by two.

The axis of symmetry A passes substantially through the two flexible leaves 105, 106, 107 of each device 101, 102, 103 when the mechanism is at rest. The centre of mass of the pivoting mass is defined by the axis of symmetry, which is the point of intersection of the second flexible leaves 105, 106, 107. The guide devices 101, 102, 103 are of the type of those described for the second embodiment of the resonator mechanism of FIGS. 3 and 4, with the exception of the supports 108, 109.

Like for the devices of FIGS. 3 and 4, the rotary supports 109 comprise first arcs 111, 112, 113. The rotary supports 109 include, in addition, second superimposed arcs of a circle 114, 115, 116, the lengths of which are different to reach first respective arcs 111, 112, 113 of each device 101, 102, 103. The first 111, 112, 113 and second arcs 114, 115, 116 are linked by a rectilinear portion 117, 118, 119. The second arcs 114, 115, 116 are rigidly connected and are extended by a first attachment 120 directed towards the outside of the mechanism 100.

The fixed supports 108 include third superimposed arcs 121, 122, 123 having various lengths according to the arrangement of the devices 101, 102, 103. The third arcs 121, 122, 123 are rigidly connected and extended towards the outside of the mechanism by a second attachment 125.

The second 114, 115, 116 and the third arcs of a circle 121, 122, 123 define a circular space inside of which the elements of the devices 101, 102, 103 are arranged, except for the attachments 120, 125. The first 120 and the second attachment 125 are, preferably, disposed symmetrically on either side of this space.

The invention also relates to an horological movement including a resonator mechanism such as one of those described above, for example for a balance of the horological movement.

The invention claimed is:

1. A device for guiding rotatably pivotally a pivoting mass about a virtual pivoting axis, the device being located in a plane and comprising:

a first support and a second support, one of which is fixed and the other of which is configured to be rotary and to form or to support the pivoting mass;

a first and a second flexible leaf oriented in a same direction when the device is at rest;

an intermediate leaf having a rigidity greater than the flexible leaves and connecting the first flexible leaf to the second, the intermediate leaf elbowed in a U-shape;

a first fixed link formed by the first support and a first end of the first leaf;

a second fixed link formed by a second end of the first leaf and by a first end of the intermediate leaf;

a third fixed link formed by a second end of the intermediate leaf and by a first end of the second leaf; and a fourth fixed link formed by at least one second end of the second leaf, wherein the first and/or the fourth link is located between the second and the third link in said direction when the device is at rest.

2. The device according to claim 1, wherein the intermediate leaf is flexible with a cross-sectional inertia greater than cross-sectional inertias of the flexible leaves.

3. The device according to claim 1, wherein the intermediate leaf has a length $x_1$ defined by the following equation:

$$x_1 = -\frac{L_1^3 + 3L_1^2|L_2| + 3L_1L_2|L_2| + L_2^3}{6L_1|L_2|};$$

where $L_1$ is a length of the first flexible leaf and $L_2$ is a length of the second flexible leaf.

4. The device according to claim 1, wherein a distance between the fourth fixed link and a center of mass of the pivoting mass is a length $x_2$ defined by the following equation:

$$x_2 = \frac{L_1^3 - 3L_1L_2|L_2| - 2L_2^3}{6|L_2|(L_1 + |L_2|)};$$

where $L_1$ is a length of the first flexible leaf and $L_2$ is a length of the second flexible leaf.

5. The device according to claim 1, wherein a length of the first leaf $L_1$=L, and the intermediate leaf has a length $x_1$ defined by the following equation:

$$x_1 = -\frac{36}{25}L.$$

6. The device according to claim 1, wherein a length of the first leaf $L_1$=L, and a distance between the fourth link and a center of mass of the pivoting mass is a length $x_2$ defined by the following equation: $x_2$=3/5 L.

7. The device according to claim 1, wherein the second flexible leaf has a length $L_2$ defined by the following equation:

$$L_2 = \frac{L}{5}.$$

8. The device according to claim 1, wherein the fourth fixed link is formed by the second end of the second leaf and by the second support, which is rotary, the first support being fixed.

9. The device according to claim 1, further comprising a second intermediate leaf, the fourth link being formed by the second end of the second leaf and a first end of the second intermediate leaf, the first support being rotary.

10. The device according to claim 9, further comprising:

a third flexible leaf between the second intermediate leaf and the second fixed support;

a fifth fixed link formed by a second end of the second intermediate leaf and by a first end of the third leaf; and a sixth fixed link formed by at least one second end of the third leaf.

11. The device according to claim 10, wherein the sixth fixed link is formed by the second end of the third leaf and the second support.

12. The device according to claim 10, wherein the fifth and the sixth link are located between the second and the third link in said direction when the device is at rest.

13. A horological resonator mechanism comprising the pivoting mass located to pivot in a rotary manner about all the virtual pivoting axis, including two devices for guiding rotatably pivotally according to claim 1.

14. The horological resonator mechanism according to claim 13, wherein the directions of the flexible leaves of the respective devices are perpendicular to one another when the mechanism is at rest.

15. The horological resonator mechanism according to claim 13, further comprising a third guide device, the three devices being superimposed.

16. The horological resonator mechanism according to claim 15, wherein the devices are distributed angularly, so that the directions of the flexible leaves of the three guide devices are located at 120° two by two.

17. The horological resonator mechanism according to claim 13, wherein the rotary supports of the devices are rigidly connected.

18. The horological resonator mechanism according to claim 13, wherein the fixed supports of the devices are rigidly connected.

19. The horological resonator mechanism according to claim 13, wherein the flexible leaves of each device have a same length two by two.

20. The horological movement comprising the horological resonator mechanism according to claim 13.

* * * * *